US006259978B1

(12) United States Patent
Feely

(10) Patent No.: US 6,259,978 B1
(45) **Date of Patent: *Jul. 10, 2001**

(54) PROGRAMMABLE RELAY DRIVER

(75) Inventor: Bennett R. Feely, McCandless, PA (US)

(73) Assignee: Union Switch & Signal, Inc., Pittsburgh, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/351,535

(22) Filed: Jul. 12, 1999

Related U.S. Application Data

(63) Continuation-in-part of application No. 08/761,126, filed on Dec. 6, 1996, now Pat. No. 5,922,034.

(51) Int. Cl.[7] ..... G05D 1/00; G06F 7/00

(52) U.S. Cl. ..... 701/19; 340/903; 246/169 R; 246/187 B; 246/167 R

(58) Field of Search ..... 701/19, 20; 246/3, 246/5, 122 R, 182 R, 124, 169 D, 169 A, 187 B, 169 R, 167 R, 121, 125, 126; 340/901, 903, 908, 682, 584, 825.44; 235/385; 375/259, 312, 344, 221, 352

(56) References Cited

U.S. PATENT DOCUMENTS

| | | | | |
|---|---|---|---|---|
| 4,041,283 | | 8/1977 | Mosier | 701/20 |
| 4,042,810 | | 8/1977 | Mosier | 701/19 |
| 4,087,066 | * | 5/1978 | Bahker et al. | 246/167 R |
| 4,087,067 | * | 5/1978 | Bahker et al. | 246/167 R |
| 4,401,035 | | 8/1983 | Spigarelli et al. | 701/20 |
| 4,711,418 | * | 12/1987 | Ayer, Jr. et al. | 246/5 |
| 4,853,883 | | 8/1989 | Nickles et al. | 701/20 |
| 5,364,047 | * | 11/1994 | Petit et al. | 246/122 R |
| 5,440,489 | | 8/1995 | Newman | 701/20 |
| 5,459,663 | | 10/1995 | Franke | 701/20 |
| 5,533,695 | | 7/1996 | Heggestad et al. | 701/19 |
| 5,535,968 | * | 7/1996 | Mokkapati et al. | 246/3 |
| 5,570,284 | | 10/1996 | Roselli et al. | 701/20 |
| 5,592,384 | | 1/1997 | Wolf | 701/19 |
| 5,713,540 | * | 2/1998 | Gerszberg et al. | 246/121 |
| 5,850,416 | * | 12/1998 | Myer | 375/221 |
| 5,864,304 | * | 1/1999 | Gerszberg et al. | 340/903 |
| 5,867,801 | * | 2/1999 | Denny | 701/35 |
| 5,907,294 | * | 5/1999 | Welte et al. | 340/903 |
| 5,922,034 | | 7/1999 | Feely | 701/19 |

* cited by examiner

*Primary Examiner*—Jacques H. Louis-Jacques
(74) *Attorney, Agent, or Firm*—David V. Radack; Eckert Seamans Cherin & Mellott, LLC

(57) ABSTRACT

A programmable device driver and system thereof are provided for segregating functions and hardware in a railway signaling environment The device driver includes a central processor with a memory and a timebase which is programmable to perform a function. The central processor may be detachable from the device driver. The central processor may be encapsulated in resin or potted to provide resistance to the environment. The device driver may be provided with voltage and current sensing inputs, a power input connected to a power conditioning circuit, one or more outputs, a conditional power supply, and mounting brackets. Each input may be provided with surge protection. The device driver may be provided with terminals for the inputs and outputs or pigtail leads for increased moisture resistance. The device driver also may be provided with a serial port for communicating with other programmable device drivers, a multifunction central processor, or other external device. The system includes multiple programmable device drivers, each one programmed to perform a certain function. Each device driver may be provided with a serial port and interconnected to form a local area network. The LAN may be additionally connected to a multifunction processor for remote control and monitoring.

13 Claims, 7 Drawing Sheets

PROGRAMMABLE RELAY DRIVER

CROSS-REFERENCE TO RELATED APPLICATION

This application is a continuation-in-part of U.S. patent application Ser. No. 08/761,126, Filed Dec. 6, 1996 now U.S. Pat. No. 5,922,034, issued Jul. 13, 1999.

BACKGROUND OF THE INVENTION

1. Field of the Invention

The present invention relates generally to the art railway signaling systems and more particularly to relays and solid-state interlocking systems.

2. Description of Related Art

Present day railway signaling systems normally employ relay interlocking, solid-state interlocking, or a combination of both.

FIG. 1A illustrates an early signaling system in which a number of relays, 1*a*–1*i*, are individually dedicated to performing multiple functions. Each relay circuit is wired to a track circuit and employs contacts to determine particular track conditions, such as whether there was a train on that section of track. Based upon the circuit design and whether or not certain contacts were open or closed each relay carries out the particular function to which it is dedicated. In this way a plurality of relays comprised the earliest interlocking railway signaling system. In this traditional relay system, multiple specially designed relays circuits each perform a particular function. A different relay circuit is provided for each function to be performed at a certain location. The overall system consists basically of multiple relays implementing multiple functions. A big disadvantage of this system is that the relay logic is fixed by the circuit design. If you want to add a new function, or modify an existing one, you must re-wire the circuit. This can entail adding new circuits and contacts, as well as adding additional relays. Since each different function requires a different relay circuit design, a large number of different circuits and types of relays are required which can result in high costs. Furthermore, as new functions are conceived of, the complexity of the circuits becomes a problem, requiring more contacts, more wiring, and more relays. The result is not only higher costs but also an increased likelihood of crossed wires and shorted circuits.

The advent of multifunction solid-state interlocking systems brought the flexibility of programmable logic and the benefits of integrated monitoring and control of an entire system. A single multifunction central processor may oversee and carry out many of the functions previously performed by relays. FIG. 1B illustrates how a multifunction solid-state system 2 may be installed at a location. Generally, the multifunction system 2 may be wired into the track circuit and the contacts formerly connected to each relay 1. The multifunction system 2 thereby receives the inputs that formerly received by the relays 1. Based upon the inputs the multifunction system 2 performs the multiple functions once carried out individually by separate relays 1. The big advantage of the multifunction system 2 is that programmable logic may be employed to evaluate the inputs and implement functions which the relays 1 either could not perform at all or for which the complexity of the circuit that would be required made it impractical. Additionally, by interconnecting multiple multifunction systems 2, a central control center can monitor conditions along practically the entire line of track in operation. This overview permits the multifunction system 2 to organize, plan and prioritize each of the multiple functions. A hybrid signaling system wherein a multifunction solid-state system interacts with traditional relays is illustrated in FIG. 1C. In this system, which is the norm, a multifunction solid-state interlocking system 2 may retain and interact with traditional relays 1 as part of an overall interlocking signaling system. The multifunction system 2 generally operates in the same manner described above, except that the multifunction system 2 additionally receives inputs from relays 1. A difference is that some of the relays 1 may perform functions 3 independent of the multifunction system 2. These relays are typically vital relays which are employed in combination with the multifunction system 2 as safeguards against certain unsafe conditions. For example, a vital relay may be employed to ensure that if a malfunction occurs, the multifunction system 2 cannot initiate a signal or other device in the face of an oncoming vehicle.

Despite the advantages of solid-state systems, such an integrated logic control and multifunction performing system can have certain disadvantages. In the relay interlocking system, all of the functions and logic are segregated, thus simplifying maintenance and troubleshooting of malfunctions. Additionally, new relay circuits can be added to perform additional functions without affecting the other relays in the rest of the system. In contrast, existing multifunction solid-state systems can be handicapped by the necessity of retesting the entire system after changes in interlocking logic or hardware is made, a typically time consuming and very expensive process. Recently developed methods of checking application logic to ensure that only the desired changes are made may not be fully satisfactory. Another problem that can be inherent in the solid-state interlocking system is latency. Because inter-processor communications are limited to a very small number of bits at sporadic intervals, latency in contemporary centralized processors can be difficult to predict before actually constructing and testing the system. Correction of latency-related problems often requires expensive redesign and additional hardware. Latency concerns may prevent consideration of real-time encoding and decoding functions for more than one or two I/O ports. Latency frequently may require disadvantageous circuit designs employing external relays or contacts, which may increase disproportionately with I/O capacity, posing additional burdens on systems with limited processor capacity. Reliability can be another-problem area which may be improved upon in contemporary multifunction solid-state systems. Generally, multifunction solid-state interlocking systems have no redundancies. Failure of any individual output, component failure, or short circuit may in some instances cause the entire system to shut down. To obtain redundancy in these systems may require two identical sets of hardware along with some sort of fail-over mechanism between them.

From an economic standpoint, conventional solid-state systems invariably have step-function cost/size relationships, limited maximum capacity and limited facilities for integration of standby hardware, data loggers, etc. Large programmable multifunction processor systems can be too costly and complex for end-of-sidings and too limited in size and speed for large rapid-transit interlockings. It is these E-O-S and rapid-transit applications where the economic benefit of solid-state interlocking is greatest because of the physical size of equipment or volume of business. For small interlockings, various subspecies of programmable multifunction systems have evolved. However, limited production volume of these smaller solid-state systems and their ever-changing configurations are an unwelcome challenge for those who must design and support these products. Elsewhere, large solid-state interlocking systems have become overly complex and costly due to system capacity limitations and the continuing need for vital relays to isolate noise or arbitrate between normal and standby outputs.

Because of the numerous disadvantages inherent in current interlocking railway signaling systems, there has arisen a need for improving the contemporary multifunction interlocking systems. Moreover, there is also a need for an economical means to upgrade older, obsolete relay interlocking systems in situations where there may not be enough economic incentive to completely convert to a multifunction solid-state interlocking system.

SUMMARY OF THE INVENTION

The present invention is a apparatus and system by which logic and hardware may be re-organized to improve various qualities of function and commercial value for railway signaling systems. Identified as a Programmable Relay Driver (PRD), the invention may be utilized to form a system of segregated logic and hardware which provides all of the advantages of solid-state interlocking systems while closely resembling the relay interlocking systems with which it will interface and may eventually replace. The PRD is a miniature, stand-alone programmable vital logic controller with immediate, practical application in today's signaling systems. Although characterized as a programmable "relay" driver, the PRD may be utilized not only to drive relays, both vital and non-vital, but also may drive, for example, other PRDs, electric switch locks, electro-pneumatic valve magnets, contactors, and GRS biased-neutral controllers. Additionally, the PRD may provide inputs to multifunction solid-state interlocking systems as one part of a larger overall interlocking railway signaling system.

Alternate methods of applying solid-state hardware to perform vital logic have focused on ever-increasing speed and I/O capacity. The PRD avoids several practical limitations that have become apparent m such systems. Existing systems having a vertically organized centralized processor and distributed I/O are unlike the PRD, which lacks a central processor shared amongst all units. The PRD concept further provides for lateral, simultaneous communication among peer PRD units, eliminating the chain-oriented handshaking organization of contemporary solid-state systems. The PRD concept can also include current-sensing inputs making possible a wide variety of new circuit design options previously unavailable using voltage-sensing inputs. Although the voltage-sensing circuitry is similar to the prior art, use of the current-sensing inputs are unique in PRD applications to vital circuits.

One of the greatest strengths of the PRD concept is its simple, small-scale modular embodiment. PRD provides most of the advantages of solid-state interlocking without the costly, inflexible, centralized structure that has handicapped present day multifunction solid-state systems. The cost of a system constructed with PRD modules is nearly proportional to its size, as with conventional relays, whereas very large and very small solid-state interlocking systems tend to be economically disadvantaged because they lack a single-function oriented structure. The PRD concept is ideally suited for applications where only a few I/O ports are needed, as is typical with radio H) systems, satellite locations and intermediate signals.

Unlike all-relay or solid-state systems, circuits (logic) can be designed in whatever form is deemed best suited for the task; hybrid half-relay, half-PRD systems are easily constructed. Flexibility is enhanced since I/O assignments of individual PRDs need not be physically or logically related. A PRD output may be used to energize its own inputs, eliminating the need for battery energy on circuits where such an arrangement would be inconvenient or undesirable (i.e., third-rail or substation indications where circuits may be exposed to high voltages under fault conditions).

Other details, objects and advantages of the apparatus and system will become apparent from the following description of the preferred embodiments shown in the drawings.

BRIEF DESCRIPTION OF THE DRAWINGS

The invention will be more readily apparent to those skilled in the art by reference to the accompanying drawings wherein.

DETAILED DESCRIPTION OF THE PREFERRED EMBODIMENTS

Figure 1A:
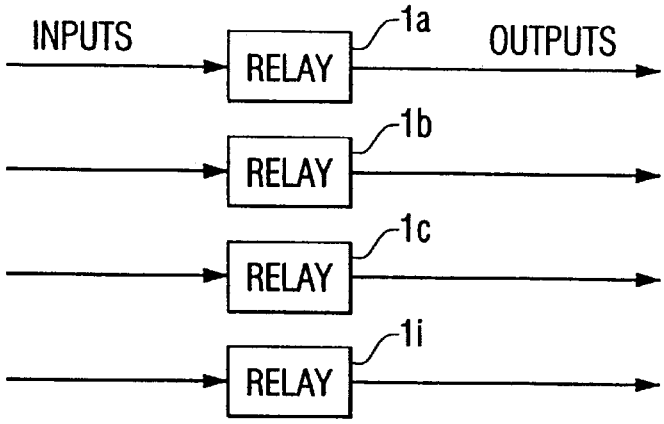
FIG. 1A PRIOR ART
FIG. 1A is a block diagram of a traditional relay interlocking system.
Figure 1B:
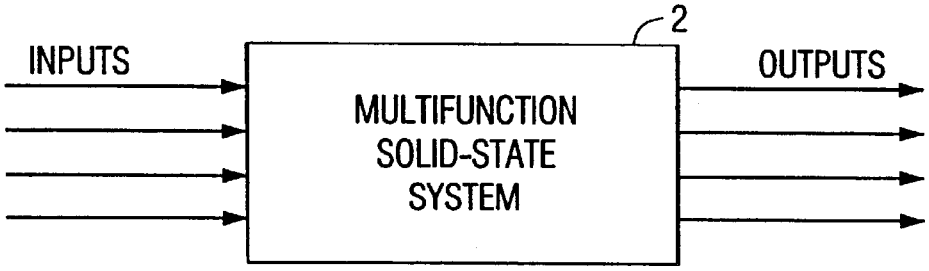
FIG. 1B PRIOR ART
FIG. 1B is a block diagram of a contemporary all solid-state interlocking system.
Figure 1C:
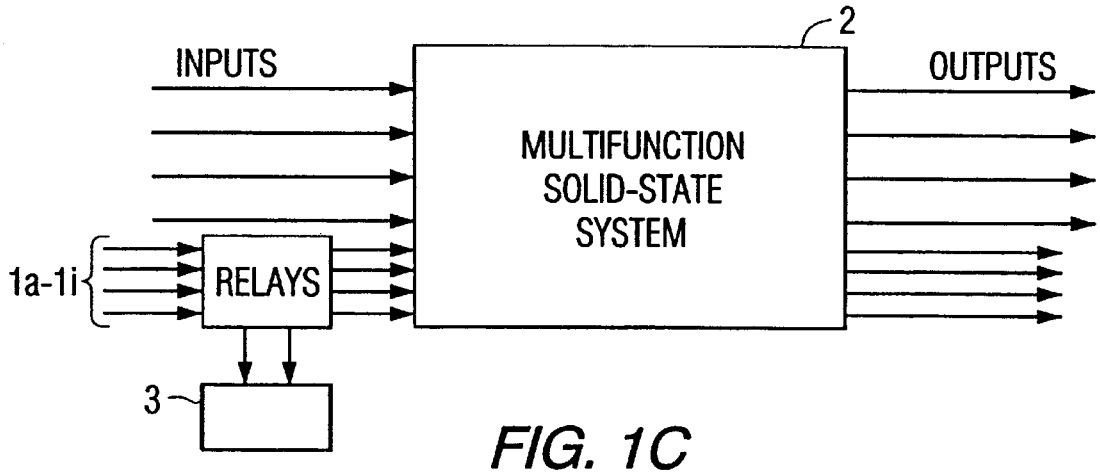
FIG. 1C PRIOR ART
FIG. 1C is a block diagram of a combination solid-state interlocking and relay system.
Figure 2:
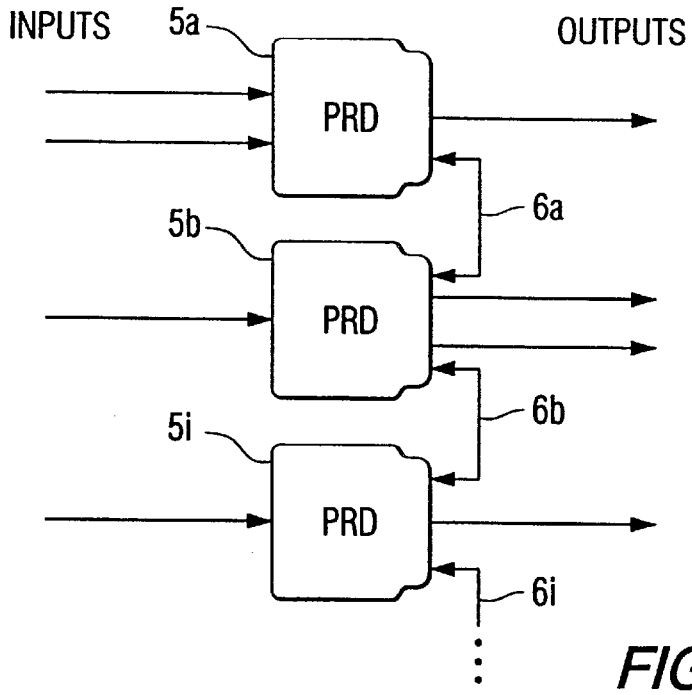
FIG. 2 is a simple block diagram of an interlocking system using the present invention.
Figure 3:
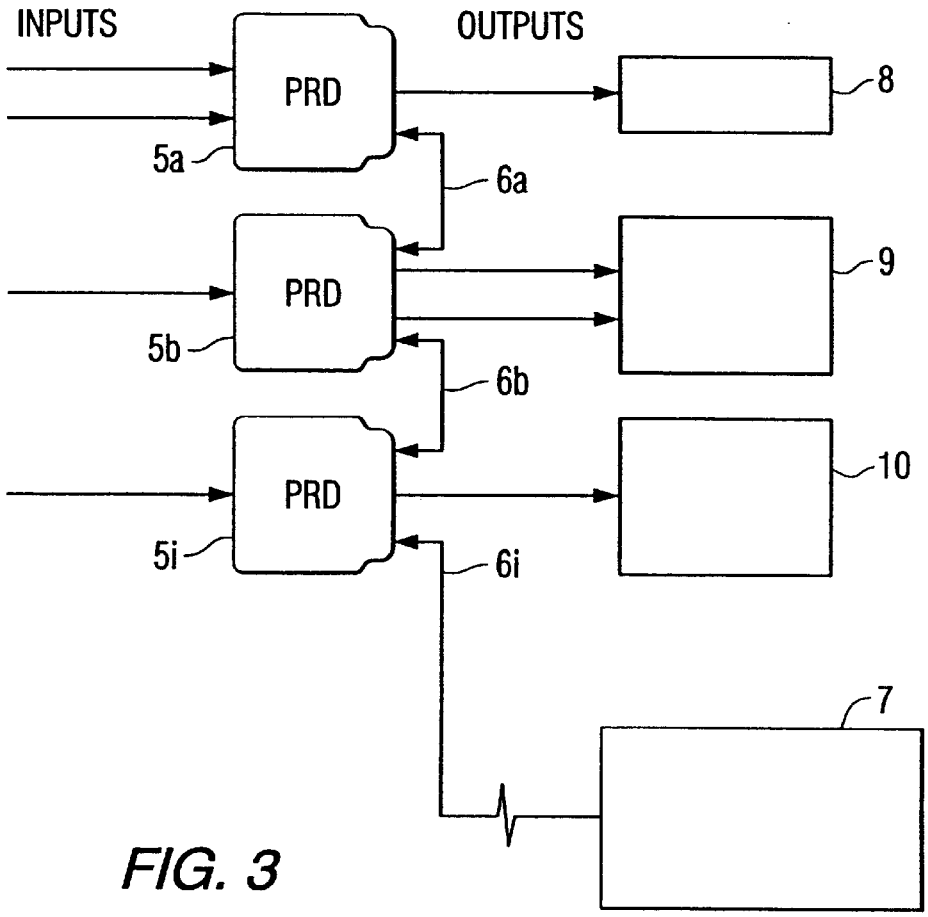
FIG. 3 is a more detailed block diagram of an interlocking system utilizing the present invention.
Figure 4:
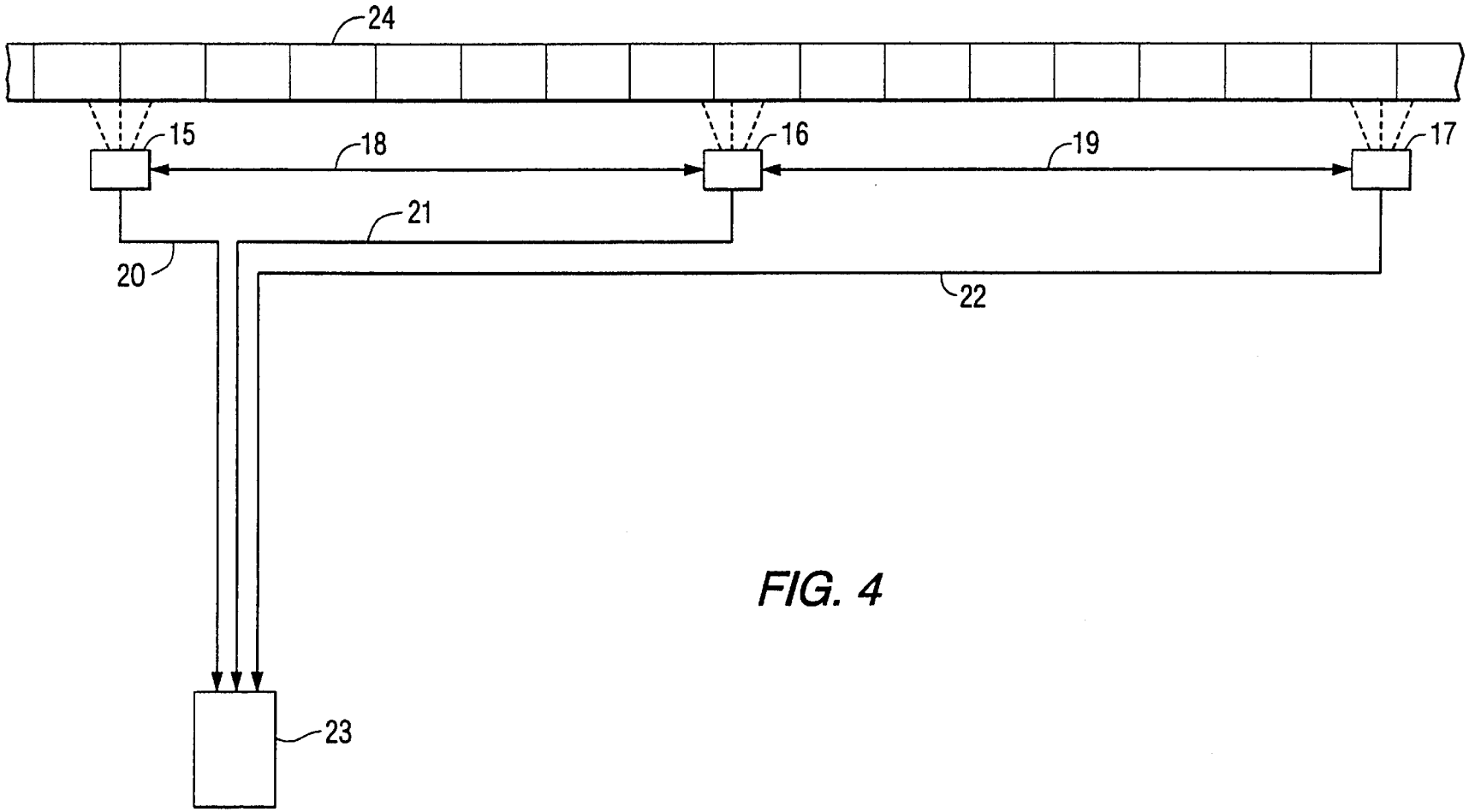
FIG. 4 is a block diagram of a section of track using an interlocking system of the present invention.
Figure 5:
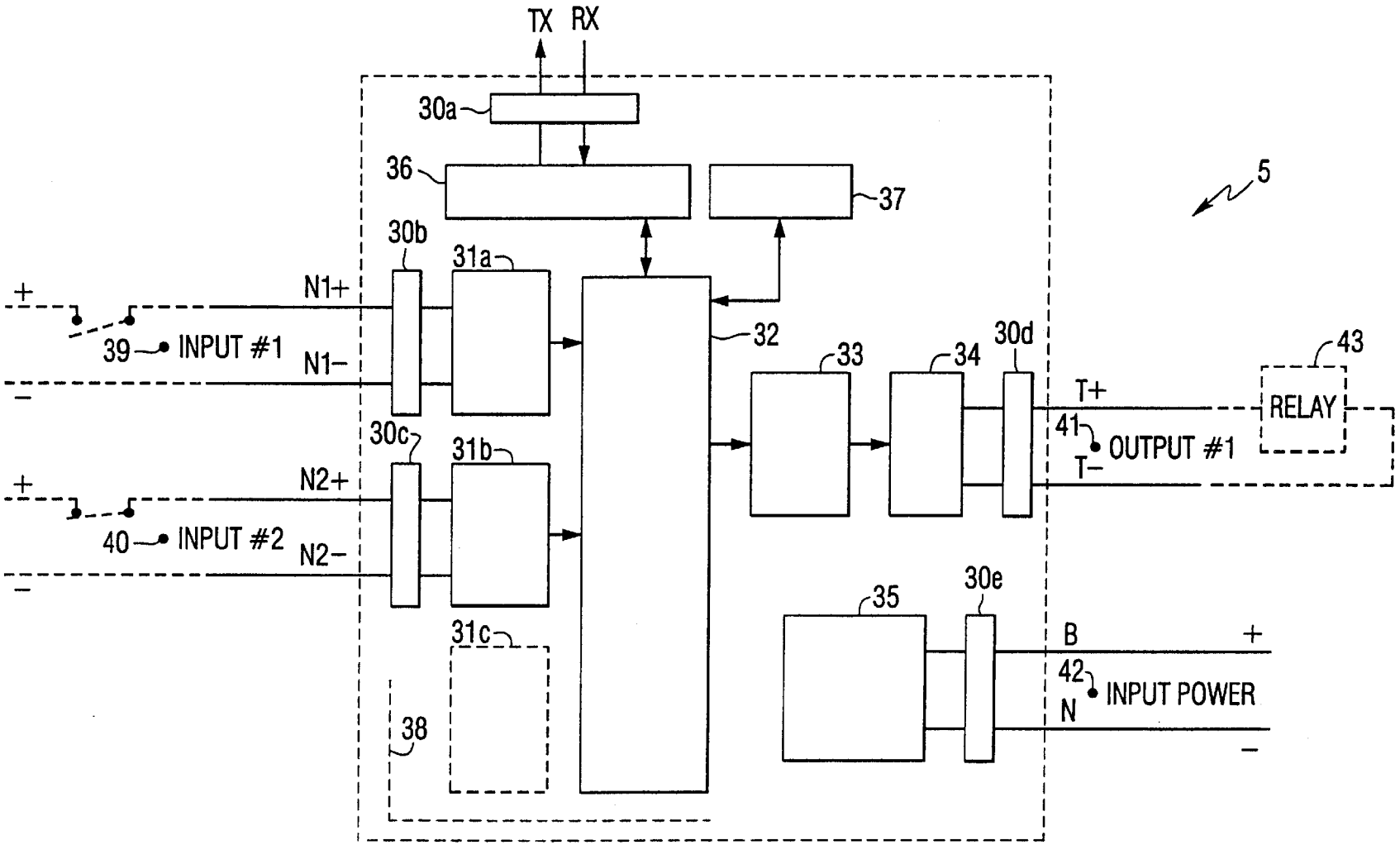
FIG. 5 is a block diagram of the internal structure of the present invention.

FIGS. 2 and 3 are block diagrams illustrating interlocking systems of multiple programmable relay drivers 5*a*–5*i* of the present invention. Like relays 1, each programmable relay driver (PRD) 5 can be dedicated to performing a particular function. However, unlike the relays 1, each PRD 5 is a solid-state programmable unit. A PRD 5 functions as a miniature multifunction solid-state system 2, except that instead of receiving many inputs and performing many functions, a PRD 5 receives a particular input and is dedicated to performing a particular function based upon that input. Moreover, each PRD 5 can be provided with a serial communications port 36, illustrated in FIGS. 5–7, and be serially interconnected, via lines 6*a*–6*i* in FIG. 2, to form a local area network (LAN). In fact, it would be possible to mimic a multifunction system 2 with multiple interconnected PRDs 5, wherein each PRD 5 performs one of the functions previously carried out by the multifunction system 2. As shown most clearly in FIG. 3, each individual PRD 5 receives particular inputs and drives a particular function, one of functions 8, 9 and 10. These functions may be, for example, relays, lamps, motors, switches, other PRDs, and other external devices. However, each PRD 5 may also monitor and store inputs from other PRDs 5 via the LAN. In this manner each PRD 5 could act as a backup for another PRD 5. The LAN formed by the interconnected PRDs 5, via serial communication lines 6*a*–6*i*, may even be extended to allow remote control and monitoring from a central control center 7. In fact, as illustrated best in FIG. 4, a possible overall railway signaling interlocking system could include a combination of relays 1, PRDs 5, and a remote multifunction solid-state processor 24 overseeing the entire system. Multiple PRDs 5 may be located at blocks 15, 16, and 17 where they receive inputs from track circuits along segment of track 24. The PRDs 5 may share information with PRDs at other locations via serial communications lines 18 and 19. The PRDs may further be connected to a central remote control center 23 via serial communication lines 20, 21 and 22. FIG. 5 is a block diagram of the internal structure of a PRD 5. The number of inputs and outputs may be adjusted to suit specific requirements; however, considering typical present day railway signaling systems, two vital inputs 39 and 40, and one vital output 41 are presently preferred from a cost and utility standpoint. A serial communications interface 36 provides for real-time communications between each PRD 5 and off-line communications for programming or test purposes. Peripheral I/O services 37 functions such as LED indicators and detection of mode selection jumpers. Input power 42 is regulated and conditioned by the input power conditioning circuitry 35. Suitable surge protection 30*a*–30*e* is provided for each metallic connection to outside circuitry. Terminals N1+, N1−, N2+, and N2− identify inputs 39 and 40. Terminals T+, T− identify output 41. Terminals B and N identify the power input 42. The CPU 32 includes a non-volatile memory, a single processor CPU, RAM memory and a timebase function using a single or dual clock. The conditional power supply 33 can be a double-tuned filter that produces a DC output only when the CPU 32 produces a continuous data stream corresponding to a predetermined frequency and modulation rate. The output isolation circuit 34 serves to isolate the conditional power supply 33 from the T+/T− leads of output 41, allowing parallel connection of other PRDs 5 without difficulty due to the presence of rectifier diodes across the output. An internal or external modem, not shown, may be provided which would carry serial data over the power circuitry, providing increased economy for many typical point-to-point applications. A single-processor system is the preferred embodiment; however, a multiprocessor system would be equally effective in accomplishing the function of the PRD 5. No particular type of serial port 36 is envisaged. The serial port 36 could be any type of serial interface, including fiber optic, RS-232 or Ethernet. Another unique feature is the use of a low-cost non-vital relay 43 to isolate the output circuitry 41 when the output is off. These contacts serve to isolate the output 41, protecting against surges and preventing undesirable backfeeding that would make bi-polar circuit connection impossible. To maximize the life of these contacts, the relay 43 will make and break the output circuit 41 only when the conditional power supply 33 is off. Both voltage-sensing and current-sensing inputs may be provided. Both voltage and current-sensing inputs are intended to function as vital level detectors. The operating mode of the PRD 5 is selected using one or more jumpers which interconnect spare pins on the serial port 36 connector plug. This selection is considered non-vital since no falsely permissive action would occur based only on an apparent change in pin connections. Alternately, the spare pins may be used for communications or peripheral functions 37 such as RTS and DTR, as commonly found on serial communications interfaces. Surge protection can be applied to every conductor extending outside the PRD 5. Additional surge protection, not shown, may be added externally where conditions warrant Surge protection can be staged according to breakdown speed and thermal capacity to maximize effectiveness and longevity of each surge protector 30*a*–30*e*. The gas discharge suppressor on the B-N input 42 can be protected against excessive current flow by a one-shot fusible trace or similar current-limiting device. Each conductor of the vital I/Os can be isolated from unrelated conductors to withstand at least 3 KV at 60 Hz for one minute. Power and communications conductors have similar isolation to the vital conductors but a lower level of isolation to each other. Application of DC energy to the input power 42 B-N terminals starts the processor and energizes other internal circuitry. The power input terminals 39 and 40 may be used as a tertiary logic input for simple applications where continuous power is not needed to support memory or serial communications. Optionally, power may be coupled to the PRD 5 inductively so that a short circuit within the PRD 5 would not result in failure of power to other PRDs. Alternating current input power may be used to provide a frequency or timebase reference. Periodic pulses transmitted over the power distribution network would be useful as a means of synchronizing PRDs.

Figure 8:
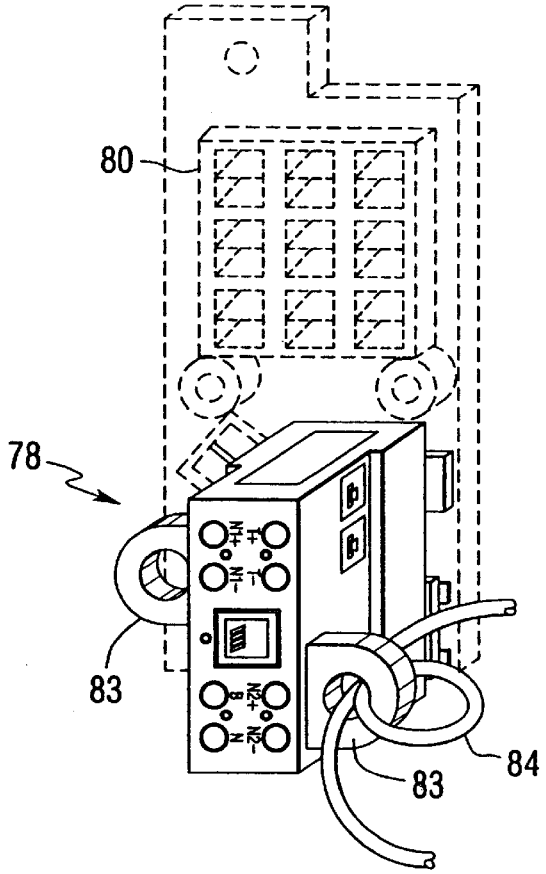
FIGS. 8 and 8A illustrate another embodiment of the present invention having current sensing inputs.

The application logic contained within the PRD 5 is expressed as a series of Boolean equations. Each equation is evaluated to produce a true/false binary result. The equations are evaluated periodically or as inputs change state. The results are applied to control the vital output 41 or serial port 36 message output. Independent of the application logic, the CPU 32 performs various checks to assure that inputs and application logic are correctly processed. Upon successful completion of these checks, a periodic digital signal is sent to the conditional power supply 33 and thence to the power output 41; a continuous stream of such signals provides steady or coded output The output 41 may be connected to any suitable device, such as a vital relay or input to a multifunction system 2, or another PRD 5. Additionally, similar to stick circuits used in relay logic, certain results may also be retained in memory to indicate a previous sequence of inputs or results. In addition to Boolean logic, the operands may be assigned a timing interval. Delay in transition from false to true or true to false is determined by the application logic during compilation of the program. Using the timing function, a wide range of useful operations can be performed, i.e., decoding of periodic input signals, encoding of the T+/T− output 41 and extended time delay for noise control purposes. One especially important application of timing is to allow the PRD 5 to emulate slow drop away, slow pickup, or flashing operating characteristics of certain conventional vital relays. Unlike relays 1, the timing interval to be applied may be selectively applied or eliminated. Another advantageous feature is the ability to use the PRD 5 where slow release relays cannot work, i.e., when their coil is in parallel with another relay or where line polarity is alternated. Fury logic and numeric operators may be added for additional functionality. Fuzzy logic is particularly useful for decoding processes; numeric operators would typically be used where arithrnetic operations are necessary, such as counting impulses from a wheel detector. Noise and surge immunity are provided by coordinated protection both inside and outside the PRD 5. Current-sensing inputs 82 and 83, shown in FIG. 8, provide inherently high immunity to slow and fast rising surges, which may be further dampened by addition of a simple shorting ring passing through the aperture. Polarity bias of inputs is another important feature. With appropriate processing of the input signals, the input information can be filtered so as to accept or reject AC energy and transient noise.

Figure 6:
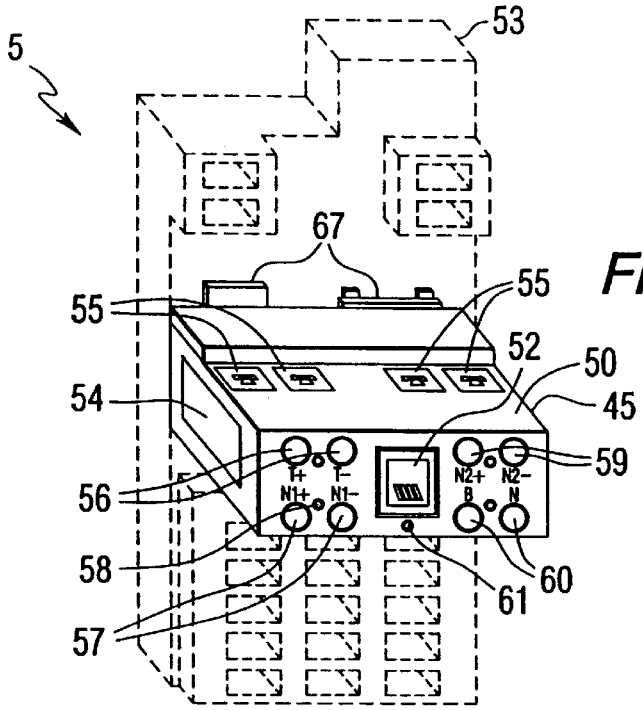
FIGS. 6 and 6A illustrate a preferred embodiment of the present invention.
Figure 6A:
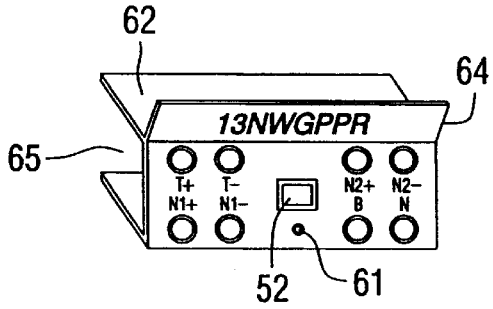

FIG. 6 illustrates a -present preferred embodiment of the PRD 5. A module 50 containing the internal logic components illustrated in FIG. 5 can be encapsulated in a urethane or epoxy package that is completely impervious to water and provides improved heat dissipation for internal components. Additionally, surface-mount components and contoured or flexible printed circuit boards could be used to reduce cost and improve reliability. The module 50 may be removably attached to the housing 45 having screw terminals for first input 57, second input 59, power input 60 and output 56. As shown in FIG. 6A a removable service cover 65 may be provided having a transparent back 62, seal hole 61, also shown in FIG. 6, and nomenclature strip 64. As shown best in FIG. 5, screw-down terminals 55 are not readily accessible without withdrawal of the cover from its normal position. However, to withdraw the cover 65 generally requires disconnection of the serial port 52. The electrical connections within the plug may be used in such a manner as to restrict operation of the PRD 5 (i.e., cut off its output) while the service cover 65 is removed and the terminals 56, 57, 59 and 60 are accessible for disconnection of wiring. The retractable service cover 65 would ordinarily be pulled backwards away from the PRD 5, thus wires to the PRD 5 would remain caged in the cover 65 while the PRD 5 was disconnected and/or replaced. This feature could eliminate the necessity of wire tagging or color coding since each wire would be readily associated with its proper terminal. Also, the service cover 65 could not readily be returned to a position which would allow connection of the serial port 36 if any two wires were cross-connected. The service cover 65 may be sealed in place by placing a suitable seal through the sealing hole 61 extending through both the cover 65 and PRD 5. The presence of this seal would indicate that the PRD 5 had not been rewired or replaced. This seal could be in the form of an electrical circuit monitored by the peripheral inputs 37 using the serial port 36 connector pins. The PRD 5 may be mounted to any suitable surface in any orientation. A preferred embodiment is mounting to the rear side of a vital relay plugboard. Alternately, a group of two or more PRDs 5 may be mounted on DIN rail. Such applications may be advantageous where the PRDs 5 are to be mounted adjacent to entrance terminals, thereby minimizing the length and impedance of wiring within the equipment housing. Such an arrangement also reduces exposure to noise and surges, particularly lightning.

Figure 7:
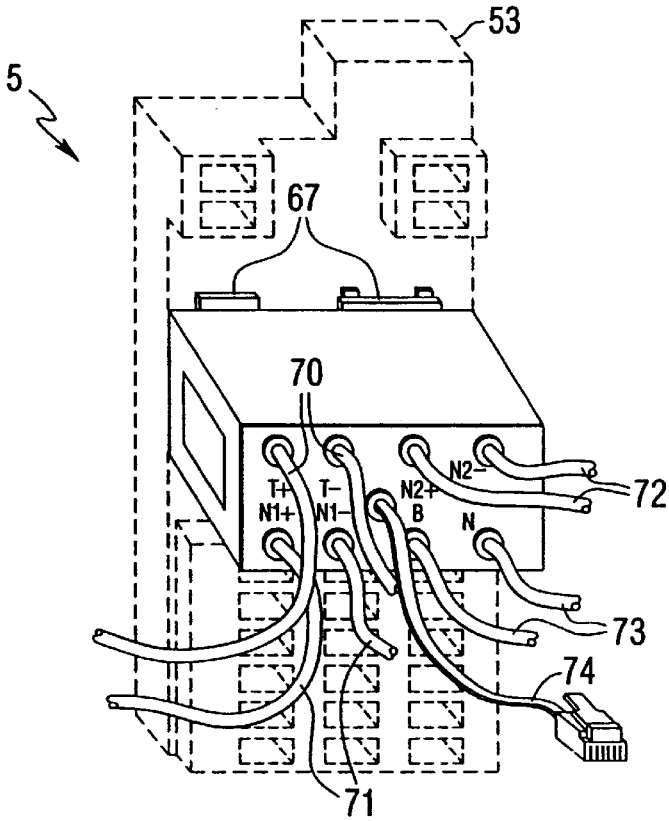
FIG. 7 illustrates another embodiment of the present invention having pigtail leads.

As an alternative to the terminals 56, 57, 59 and 60, the PRD 5 may be provided with pigtail-leads 70–74, as shown in FIG. 7, which would be ideally suited for applications where low cost and moisture resistance are essential. The module 50 could be potted after connection of the pigtail leads in the shop or field using materials and techniques similar to those commonly employed to close and seal cable splices.

Figure 8A:
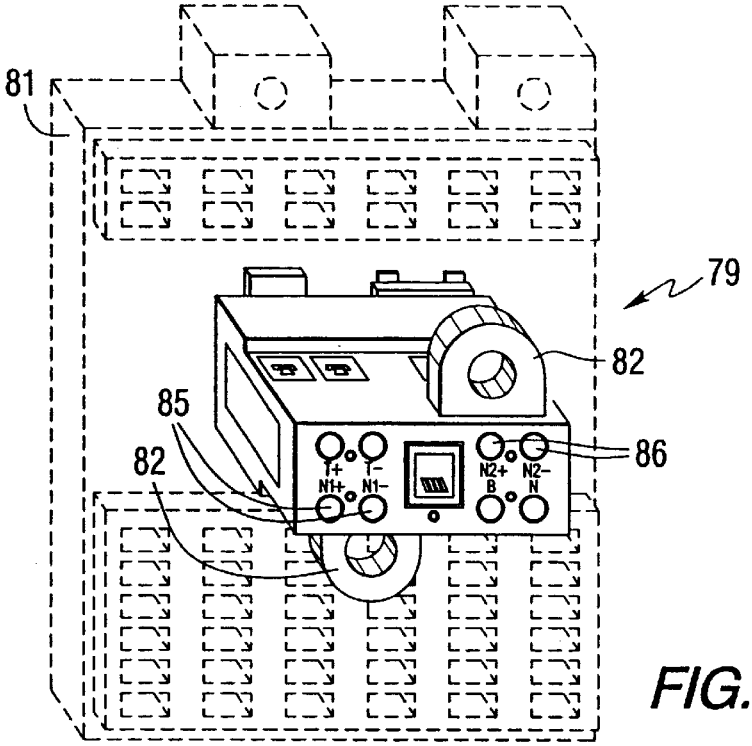

FIGS. 8 and 8A illustrate alternative forms of the PRD 78 and 79 provided with current-sensing inputs 82 and 83, respectively. For the broad range of conventional signaling circuits, a turn-on sensitivity of 75–125 milliamps per turn would be optimal. One or more turns of wire 84 may be passed through the aperture to multiply the sensitivity of the sensor. Jumper terminals 85 and 86 are provided so that circuit wires may be conveniently broken at the unit, simplifying the task of replacement of the unit if necessary. Other features remain unchanged for the current-sensing PRD. Current-sensing inputs would offer many new opportunities for improved circuit design. A very advantageous feature of a PRD 5 with current-sensing inputs is the ability to insert it in series with an existing circuit without introducing a voltage drop. Furthermore, the current-sensing input allows the circuit to remain unbroken by devices that may have less current-handling capacity or lower insulation levels than would otherwise be required, thus minimizing the number of differing configurations needed to construct a working system. The current-sensing PRD offers a means of logically combining two or more circuits without electrically interconnecting the circuits, which is very important where dangerous voltages must be monitored or circuits must be isolated for system safety purposes. PRDs having current-sensing inputs may be organized so that two or more inputs are linked serially, thus minimizing the possibility that any one PRD may fail to receive an input signal due to failure of wiring or connections. Current-sensing PRDs would also be very useful where circuits having differing voltages are used as inputs to the PRD. By selecting the appropriate limiting resistor, any circuit can be made to operate at the level of current needed to trigger the current-sensing input. This feature eliminates the need for differing configurations of PRDs having various ranges of input voltage. Additionally, multiple turns of the conductor wire 84 through the current-sensing apertures 82 and 83 may be used to boost the apparent level of current in the circuit. A present preferred current-sensing element could be a Hall-effect device, however, any suitable AC/DC current sensor may be employed.

While the previously described embodiment shows a hard-wired communication system, it will be appreciated that the PRD can be used with wireless communications. By the use of the term "wireless" herein, it is meant any type of communication system that does not involve a physical link. This could include, but is expressly not limited to, apparatus and methods therefore related to inductive coupling, infrared coupling, acoustic coupling, or 900 MHZ and 2.4 GHZ wireless LAN systems, such as IEEE 802.11.

Figure 9:
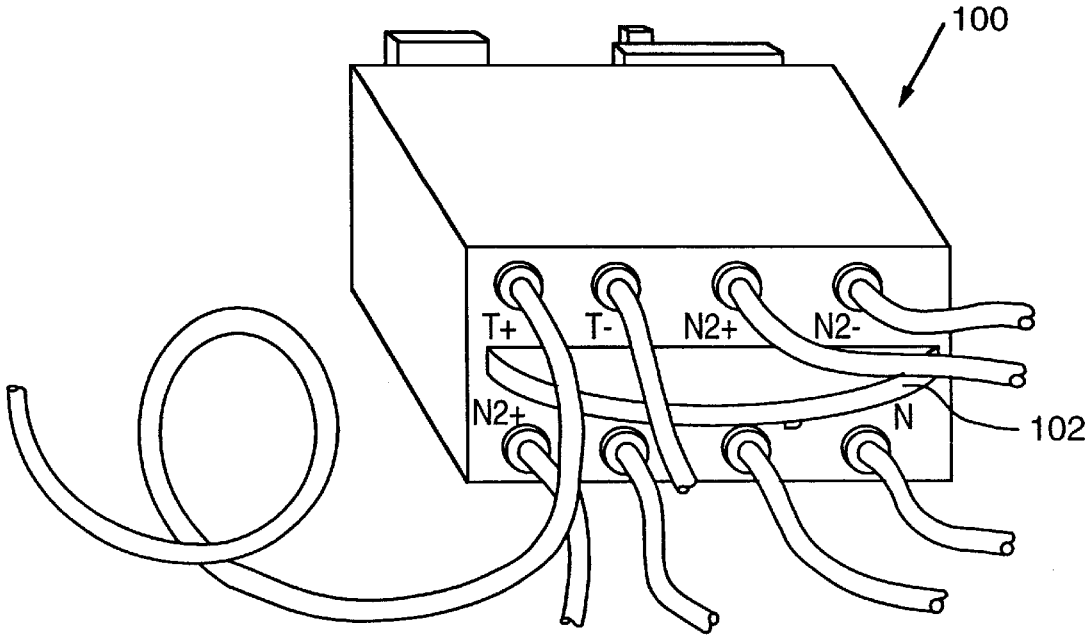
FIG. 9 illustrates another embodiment of the present invention, only showing a wireless system.

Referring to FIG. 9, there is shown a wireless PRD 100. This PRD 100 is similar to that shown in FIG. 7 except that PRD 100 includes a patch antennae 102 that facilitates wireless communication. It will be understood to those skilled in the art that internal to the unit there will be provided appropriate circuitry to further facilitate the desired wireless communication.

While specific embodiments of the invention have been described in detail, it will be appreciated by those skilled in the art that various modifications and alternatives to those details could be developed in light of the overall teachings of the disclosure. Accordingly, the particular system and apparatus disclosed herein are intended to be illustrative only and not limiting to the scope of the invention which should be awarded the fill breadth of the following claims and any and all embodiments thereof.

What is claimed is:

1. A railway signaling apparatus for performing multiple functions comprising:

a plurality of programmable device drivers each dedicated to performing a single one of said multiple functions;

each of said programmable device drivers having a central processing unit with memory; said central processing unit programmable to implement said single one of said multiple functions;

said central processing unit accepting at least one input related to said single one of said multiple functions;

said central processing unit deriving at least one output corresponding to said single one of said multiple functions; and each of said programmable device drivers including wireless communication means to permit said programmable device to communicate with an external device.

2. The apparatus of claim 1, wherein said external device includes at least one of: additional ones of said programmable device drivers; a multifunction central processing unit; a remote traffic control computer; and a local processor having stored programming for said programmable device driver.

3. The apparatus of claim 1, wherein said wireless communication means is selected from the group consisting of inductive coupling means; infrared coupling means; acoustic coupling means; ultrasonic means; 900 MHZ wireless LAN system means; and 2.4 GHZ wireless LAN system means.

4. A railway signaling apparatus for performing a single function comprising a programmable device driver having a central processing unit with a memory programmable to implement said single function, said central processing unit accepting at least one input and deriving at least one output for implementing said single function, said programmable device driver including wireless communication means to permit said programmable device to wirelessly communicate with an external device.

5. The apparatus of claim 4, wherein said external device includes at least one of: additional ones of said programmable device drivers; a multifunction central processing unit; a remote traffic control computer; and a local processor having stored programming for said programmable device driver.

6. The apparatus of claim 4, wherein said wireless communication means is selected from the group consisting of inductive coupling means; infrared coupling means; acoustic coupling means; ultrasonic means; 900 MHZ wireless LAN system means; and 2.4 GHZ wireless LAN system means.

7. A railway signaling method for performing multiple functions comprising:

providing a plurality of programmable device drivers, each of said programmable device drivers having a central processing unit with a memory;

dedicating each of said programmable device drivers to performing a single one of said multiple functions;

receiving at least one input related to said single one of said multiple functions;

deriving at least one output corresponding to said single one of said multiple functions;

programming each of said central processing units to implement a single one of said multiple function; and wirelessly communicating each of said programmable device drivers with an external device.

8. The method of claim 7, wherein said external device includes at least one of another programmable device driver, a multifunction central processing unit, a remote traffic control computer, and a local processor having stored programming for said programmable device driver.

9. The method of claim 7, including wirelessly communicating each of said programmable device drives with said external device by inductive coupling means.

10. The method of claim 7, wherein wirelessly communicating each of said programmable device drives with said external device by infrared coupling means.

11. The method of claim 7, wherein wirelessly communicating each of said programmable device drives with said external device by acoustic coupling means.

12. The method of claim 7, wherein wirelessly communicating each of said programmable device drives with said external device by 900 MHZ wireless LAN system means.

13. The method of claim 7, wherein wirelessly communicating each of said programmable device drives with said external device by 2.4 GHZ wireless LAN system means.

* * * * *